US011994140B2

(12) United States Patent
Perevozchikov et al.

(10) Patent No.: US 11,994,140 B2
(45) Date of Patent: May 28, 2024

(54) SURGE CONTROL SYSTEMS AND METHODS FOR DYNAMIC COMPRESSORS

(71) Applicant: Copeland LP, Sidney, OH (US)

(72) Inventors: Michael M. Perevozchikov, Tipp City, OH (US); Matthew J. Swallow, Versailles, OH (US)

(73) Assignee: Copeland LP, Sidney, OH (US)

( * ) Notice: Subject to any disclaimer, the term of this patent is extended or adjusted under 35 U.S.C. 154(b) by 526 days.

(21) Appl. No.: 17/247,725

(22) Filed: Dec. 21, 2020

(65) Prior Publication Data

US 2022/0196025 A1 Jun. 23, 2022

(51) Int. Cl.

| | |
|---|---|
| ***F04D 27/00*** | (2006.01) |
| ***F04D 17/10*** | (2006.01) |
| ***F04D 25/06*** | (2006.01) |
| ***F04D 27/02*** | (2006.01) |

(52) U.S. Cl.

CPC ..... *F04D 27/001* (2013.01); *F04D 17/10* (2013.01); *F04D 25/06* (2013.01); *F04D 27/0215* (2013.01); *F04D 27/0292* (2013.01)

(58) Field of Classification Search

CPC ..... F04D 27/001; F04D 27/009–0223; F04D 27/0292; F04D 25/06

See application file for complete search history.

(56) References Cited

U.S. PATENT DOCUMENTS 4,151,725 A 5/1979 Bauman et al.
4,581,900 A 4/1986 Lowe et al.
4,594,051 A * 6/1986 Gaston ..... G01K 3/10 415/48
4,608,833 A * 9/1986 Kountz ..... F25B 49/022 62/201
4,940,391 A 7/1990 Elms et al.
(Continued)

FOREIGN PATENT DOCUMENTS

EP 2765313 A1 8/2014
JP H1162887 A 3/1999
(Continued)

OTHER PUBLICATIONS

PCT International Search Report and Written Opinion of the International Searching Authority PCT/US2021/062800 dated Jun. 27, 2022 regarding PCT/US2021/062800; pp. 1-20.

*Primary Examiner* — Alexander B Comley
(74) *Attorney, Agent, or Firm* — Armstrong Teasdale LLP

(57) ABSTRACT

A system includes a dynamic compressor and a controller. The dynamic compressor includes a motor having a driveshaft rotatably supported within the dynamic compressor and a compression mechanism connected to the driveshaft and operable to compress a working fluid upon rotation of the driveshaft. The controller is connected to the motor and includes a processor and a memory. The memory stores instructions that program the processor to operate the motor to compress the working fluid at a motor speed greater than a predicted minimum surge speed plus a control margin, determine when surge events have occurred, store, in the memory, an indication of each surge event that the processor determined to have occurred, and determine whether or not to take a protective action when the processor determines that a surge event has occurred.

14 Claims, 14 Drawing Sheets

(56) References Cited

U.S. PATENT DOCUMENTS

| | | | | |
|---|---|---|---|---|
| 5,746,062 | A * | 5/1998 | Beaverson | F25B 1/053 62/228.3 |
| 5,971,712 | A * | 10/1999 | Kann | F04D 27/001 417/18 |
| 8,070,456 | B2 | 12/2011 | Mertens et al. | |
| 8,239,091 | B2 | 8/2012 | Mertens et al. | |
| 9,506,474 | B2 * | 11/2016 | Xiao | F02D 41/0007 |
| 2005/0158172 | A1 | 7/2005 | Snyder et al. | |
| 2010/0296914 | A1 * | 11/2010 | Staroselsky | F04D 27/001 415/47 |
| 2011/0093133 | A1 * | 4/2011 | Turney | F25B 1/053 700/300 |
| 2014/0026598 | A1 * | 1/2014 | Trawicki | F25B 49/00 62/126 |
| 2014/0219820 | A1 | 8/2014 | Koki et al. | |
| 2014/0260388 | A1 * | 9/2014 | Umeda | F25B 1/053 62/208 |
| 2017/0002820 | A1 * | 1/2017 | Benim | F04D 27/02 |

FOREIGN PATENT DOCUMENTS

| | | | |
|---|---|---|---|
| JP | 2019074220 | A | 5/2019 |
| WO | 2014191051 | A1 | 12/2014 |

* cited by examiner

SURGE CONTROL SYSTEMS AND METHODS FOR DYNAMIC COMPRESSORS

FIELD

The field of the disclosure relates generally to control systems, and more particularly, to control systems for machines including dynamic compressors.

BACKGROUND

Dynamic compressors, including centrifugal compressors, are used in many applications, such as HVAC. Centrifugal compressors have a driveshaft operatively connected to a motor between compression mechanisms or impeller stages that is supported by gas foil bearings. The driveshaft can be positioned between impeller stages so the impellers are rotated at a rotation speed to compress the refrigerant to a selected pressure in an HVAC system. The compressor bearings are typically provided with one or more features to reduce friction between the compressor bearing and the driveshaft. Once the shaft is spinning fast enough, gas pushes the foil away from the shaft so that no contact occurs. The shaft and gas foil bearing are separated by the gas's high pressure, which is generated by the rotation that pulls gas into the bearing via viscosity effects. A high speed of the shaft with respect to the gas foil bearing is required to initiate the gas gap, and once this has been achieved, no contact should occur. These bearings have several advantages over other bearings including reduced weight, stable operation at higher speeds and temperatures, low power loss at high speeds, and long life with little maintenance.

Compressor surge events cause accelerated wear of the compressor and compressor components, including bearings. Surge is a characteristic behavior of a dynamic compressor that can occur when the head developed by the compressor is insufficient to overcome the system pressure at the discharge of the compressor. Once surge occurs, the output pressure of the compressor is drastically reduced, resulting in flow reversal within the compressor. When a dynamic compressor surges, there is an actual reversal of gas flow through the impeller. The surge usually starts in one stage of a multistage compressor and can occur very rapidly. Compressors are especially susceptible to surge events during startups and shutdowns due to the lower operating speeds. The severity of surge events and the damage they cause increases with compressor speed.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

According to one aspect of this disclosure, a system includes a dynamic compressor and a controller. The dynamic compressor includes a motor having a driveshaft rotatably supported within the dynamic compressor and a compression mechanism connected to the driveshaft and operable to compress a working fluid upon rotation of the driveshaft. The controller is connected to the motor and includes a processor and a memory. The memory stores instructions that program the processor to operate the motor to compress the working fluid at a motor speed greater than a predicted minimum surge speed plus a control margin, determine when surge events have occurred, store, in the memory, an indication of each surge event that the processor determined to have occurred, and determine whether or not to take a protective action when the processor determines that a surge event has occurred.

Another aspect is a controller for a dynamic compressor including a motor and a compression mechanism connected to the motor and operable to compress a working fluid upon operation of the motor. The controller includes a processor and a memory. The memory stores instructions that program the processor to operate the motor to compress the working fluid at a motor speed greater than a predicted minimum surge speed plus a control margin, determine when surge events have occurred, store, in the memory, an indication of each surge event that the processor determined to have occurred, and determine whether or not to take a protective action when the processor determines that a surge event has occurred.

Another aspect is a method for controlling a dynamic compressor including a motor and a compression mechanism connected to the motor and operable to compress a working fluid upon operation of the motor. The method includes operating the motor to compress the working fluid at a motor speed greater than a predicted minimum surge speed plus a control margin, determining when surge events have occurred, storing an indication of each surge event that the processor determined to have occurred, and determining whether or not to take a protective action when the processor determines that a surge event has occurred.

Various refinements exist of the features noted in relation to the above-mentioned aspects. Further features may also be incorporated in the above-mentioned aspects. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

The following figures illustrate various aspects of the disclosure.

Corresponding reference characters indicate corresponding parts throughout the drawings.

DETAILED DESCRIPTION

For conciseness, examples will be described with respect to a centrifugal compressor with gas foil bearings (GFB). However, the methods and systems described herein may be applied to any suitable dynamic compressor. In a surge control system of a centrifugal compressor, monitoring for surge event occurrences, monitoring the number of surge events that have happened, monitoring severity of surge events, determining surge thresholds, determining the relationship between motor speed and surge events, adjusting control margins to provide larger surge margin, and determining whether or not to take protective action, such as generating alerts, stopping operation of the machine, and the like, when a surge event has occurred may prevent damage and increase centrifugal compressor life. These steps may further prevent catastrophic failure of a centrifugal compressor by enabling more accurate scheduling of preventative maintenance, increasing sensitivity of surge prevention controls, improving reliability by limiting surge severity on start-up by holding the centrifugal compressor at a lower speed until stable, allowing the system to continue to provide cooling by increasing runtime on the centrifugal compressor before faulting and shutting down, and improving reliability by limiting surge severity by operating an unloading device on surge detection instead of on estimated maps.

Figure 1:
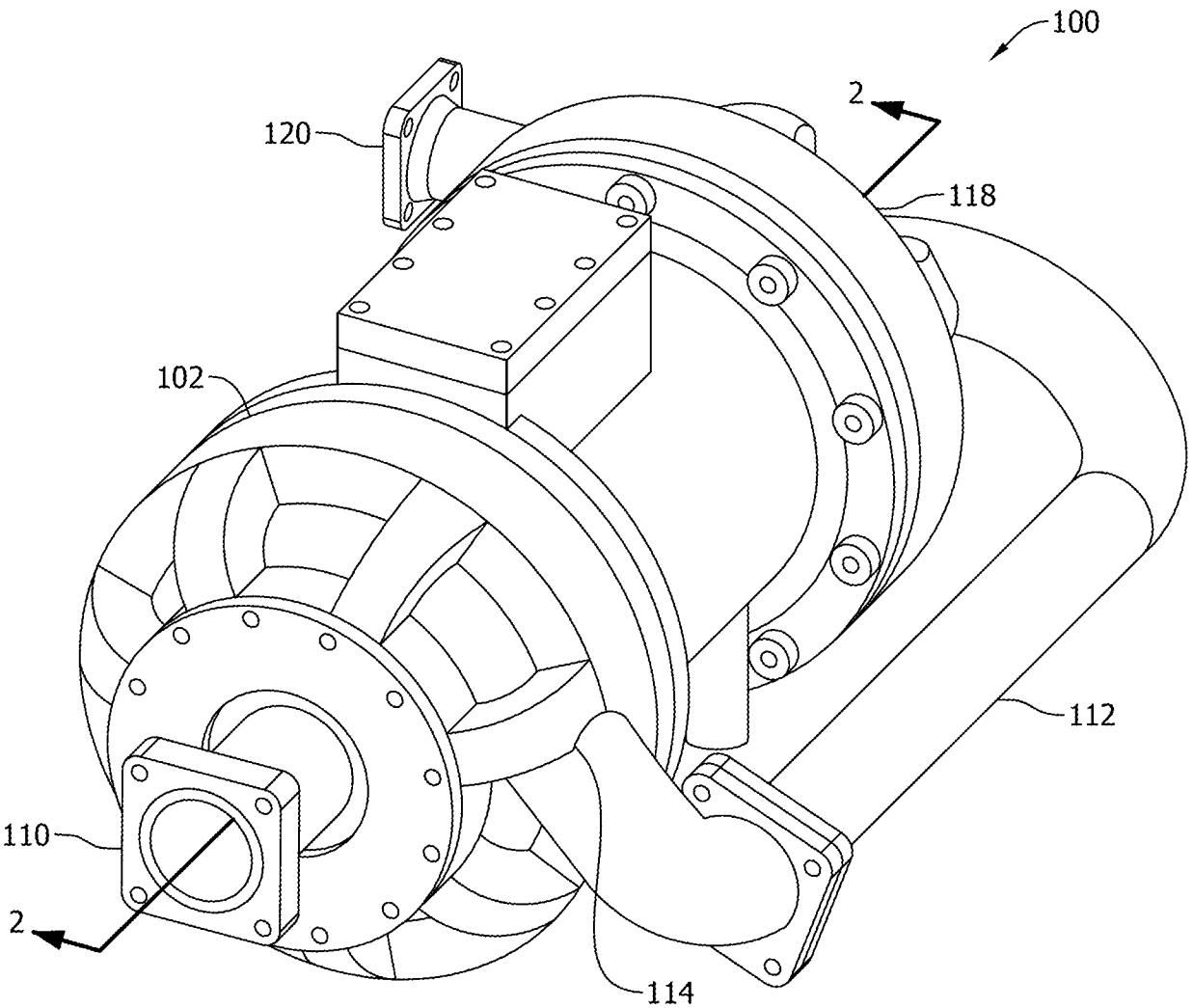
FIG. 1 is a perspective view of an assembled compressor.

Referring to FIG. 1, a compressor illustrated in the form of a two-stage refrigerant compressor is indicated generally at 100. The compressor 100 generally includes a compressor housing 102 forming at least one sealed cavity within which each stage of refrigerant compression is accomplished. The compressor 100 includes a first refrigerant inlet 110 to introduce refrigerant vapor into the first compression stage (not labeled in FIG. 1), a first refrigerant exit 114, a refrigerant transfer conduit 112 to transfer compressed refrigerant from the first compression stage to the second compression stage, a second refrigerant inlet 118 to introduce refrigerant vapor into the second compression stage (not labeled in FIG. 1), and a second refrigerant exit 120. The refrigerant transfer conduit 112 is operatively connected at opposite ends to the first refrigerant exit 114 and the second refrigerant inlet 118, respectively. The second refrigerant exit 120 delivers compressed refrigerant from the second compression stage to a cooling system in which compressor 100 is incorporated.

Figure 2:
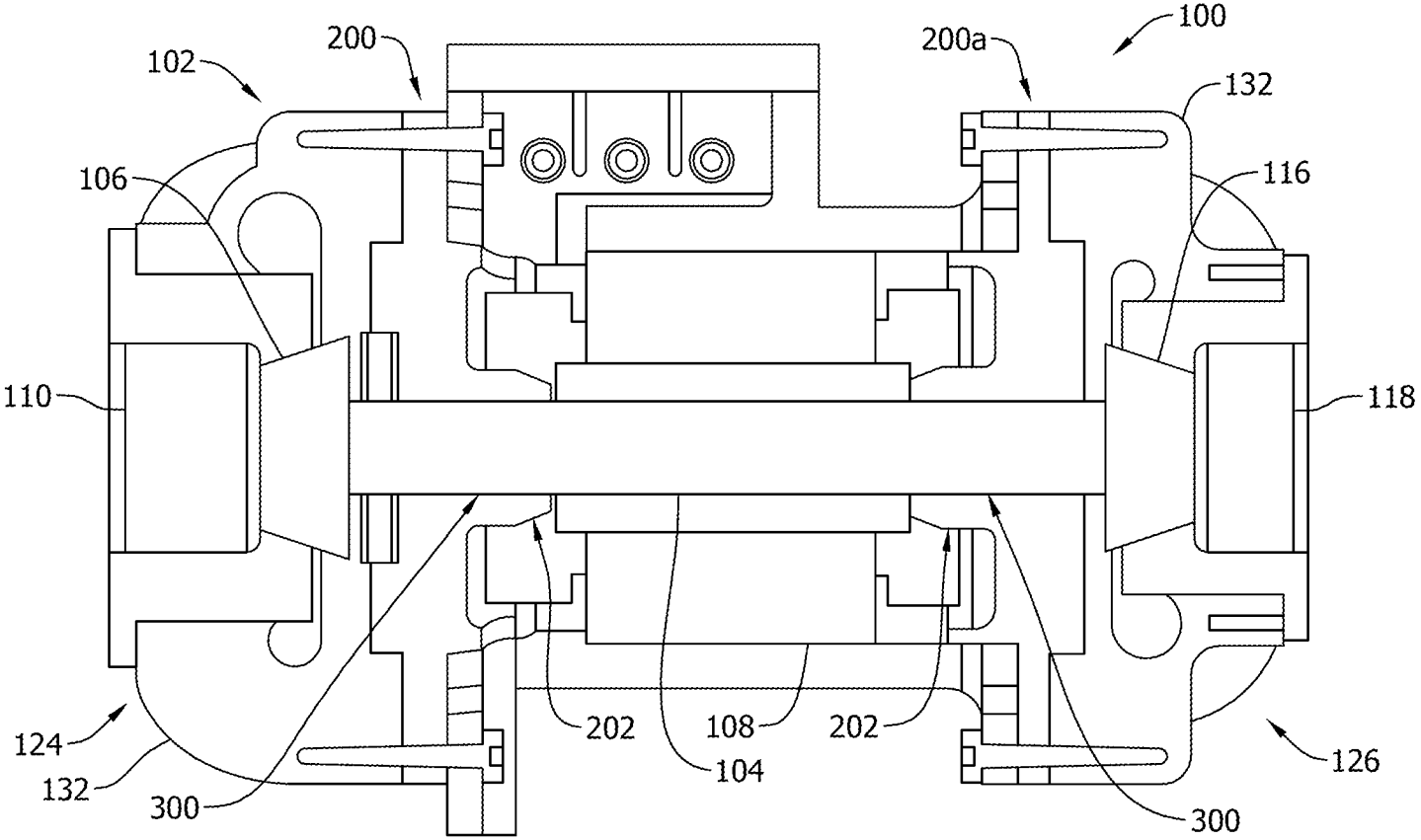
FIG. 2 is a cross-sectional view of the compressor of FIG. 1 taken along line 2-2, with the external conduit removed.

Referring to FIG. 2, the compressor housing 102 encloses a first compression stage 124 and a second compression stage 126 at opposite ends of the compressor 100. The first compression stage 124 includes a first compression mechanism 106 configured to add kinetic energy to refrigerant entering via the first refrigerant inlet 110. In some embodiments, the first compression mechanism 106 is an impeller. The kinetic energy imparted to the refrigerant by the first compression mechanism 106 is converted to increased refrigerant pressure as the refrigerant velocity is slowed upon transfer to a sealed cavity (e.g., a diffuser) formed within the volute 132. Similarly, the second compression stage 126 includes a second compression mechanism 116 configured to add kinetic energy to refrigerant transferred from the first compression stage 124 entering via the second refrigerant inlet 118. In some embodiments, the second compression mechanism 116 is an impeller. The kinetic energy imparted to the refrigerant by the second compression mechanism 116 is converted to increased refrigerant pressure as the refrigerant velocity is slowed upon transfer to a sealed cavity (e.g., a diffuser) formed within the volute 132. Compressed refrigerant exits the second compression stage 126 via the second refrigerant exit 120 (not shown in FIG. 2).

Referring to FIG. 2, the first stage compression mechanism 106 and second stage compression mechanism 116 are connected at opposite ends of a driveshaft 104. The driveshaft 104 is operatively connected to a motor 108 positioned between the first stage compression mechanism 106 and second stage compression mechanism 116 such that the first stage compression mechanism 106 and second stage compression mechanism 116 are rotated at a rotation speed selected to compress the refrigerant to a pre-selected mass flow exiting the second refrigerant exit 120 (not shown in FIG. 2). Any suitable motor may be incorporated into the compressor 100 including, but not limited to, an electrical motor. The driveshaft 104 is supported by gas foil bearing assemblies 300 positioned within a sleeve 202 of each bearing housing **200/200*a*, as described in additional detail below. Each bearing housing 200/200*a* includes a mounting structure (not shown) for connecting the respective bearing housing 200/200*a* to the compressor housing 102, as illustrated in FIG. 2**.

Figure 3:
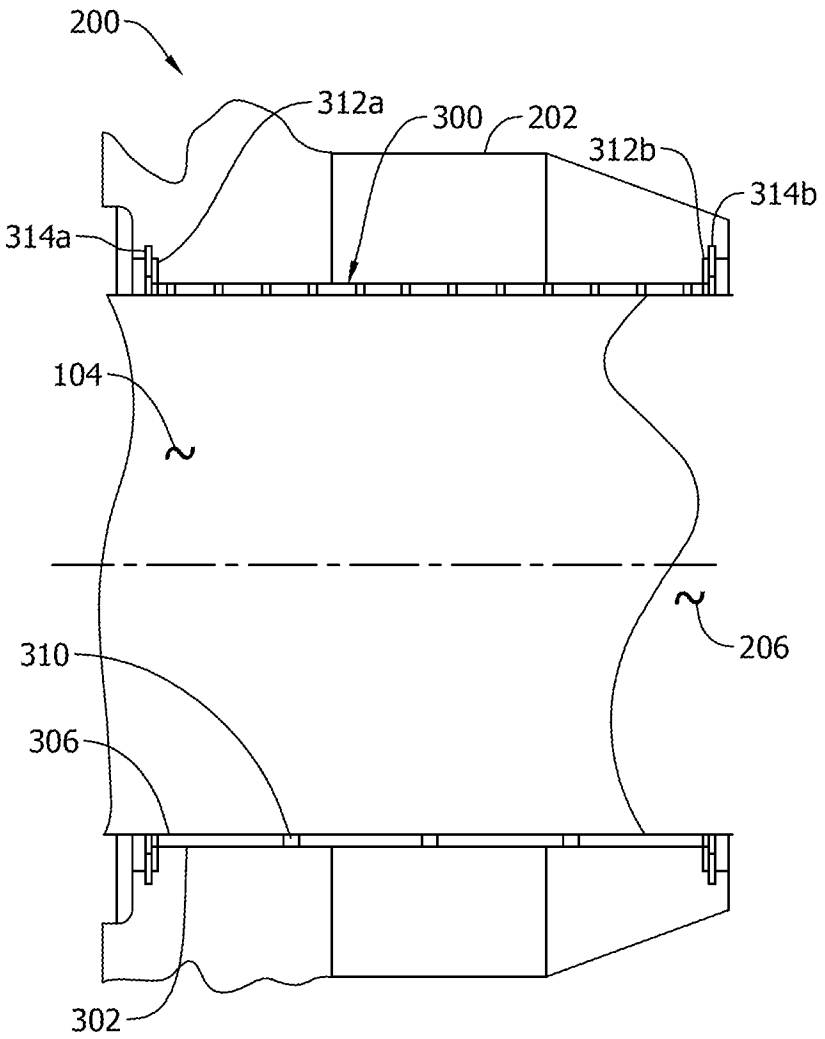
FIG. 3 is a cross-sectional view through a sleeve of the bearing housing shown in FIG. 2, illustrating the driveshaft supported within a foil bearing assembly maintained within the sleeve of the bearing housing using a pair of retaining clips.
Figure 5:
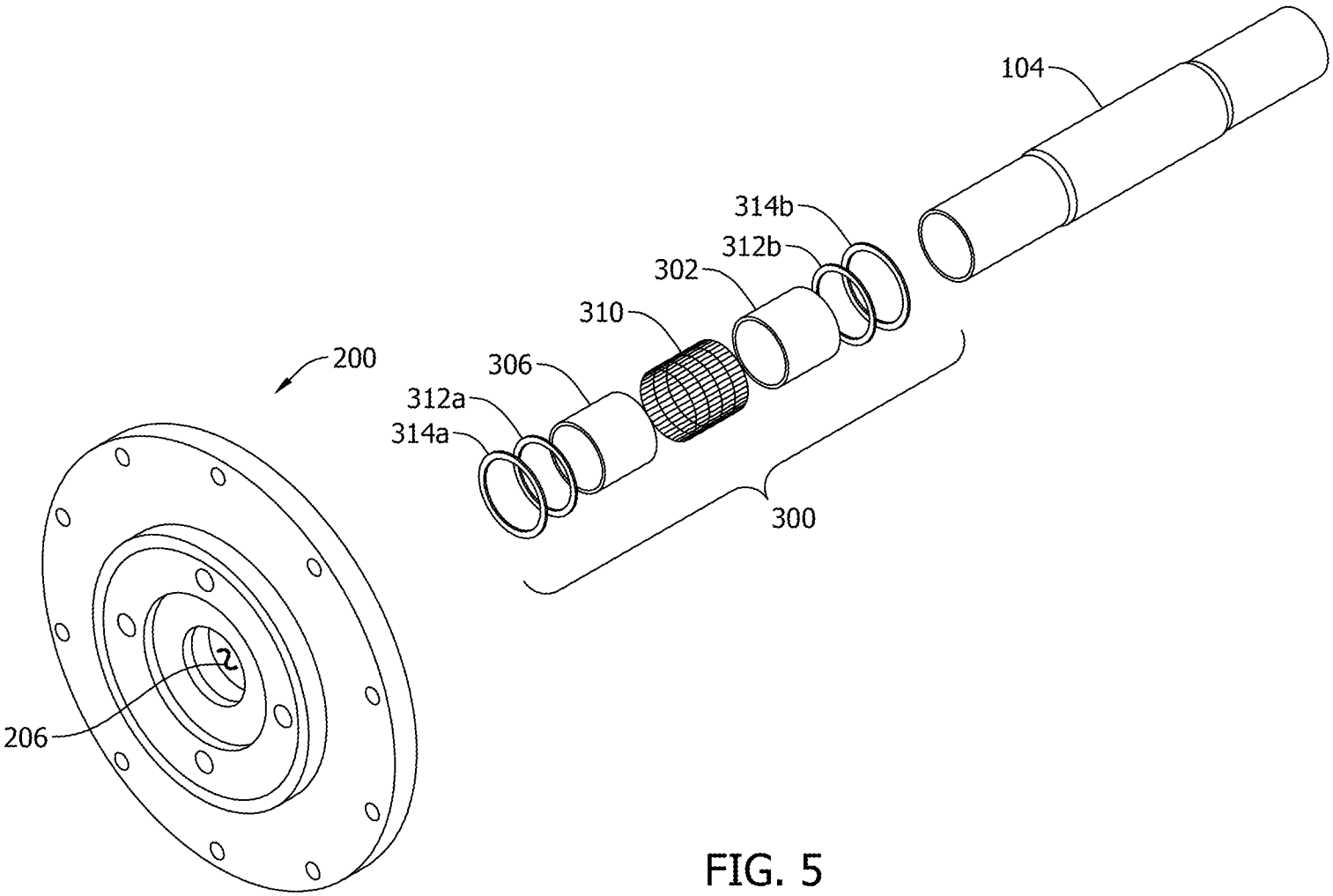
FIG. 5 is an exploded view of elements of the foil bearing assembly arranged with respect to the bearing housing and the driveshaft.

Referring to FIG. 2, each bearing housing **200/200*a* supports the driveshaft 104, the driveshaft 104 projects through the bearing housing 200/200*a* opposite the sleeve 202, and the compression mechanism 106 is connected to the projecting end of the driveshaft 104. Referring to FIG. 3 and FIG. 5, the gas foil bearing assembly 300 is positioned within a cylindrical bore 206 within the bearing housing 200. The driveshaft 104 closely fits within the gas foil bearing assembly 300, which includes an outer compliant foil or foil layer 302 positioned adjacent to the inner wall of the sleeve 202, an inner compliant foil or foil layer 306 (also referred to as a "top foil") positioned adjacent to the driveshaft 104, and a bump foil or foil layer 310 positioned between the inner foil layer 306 and the outer foil layer 302. The foils or layers 302/306/310 of the gas foil bearing assembly form an essentially cylindrical tube sized to receive the driveshaft 104 with relatively little or no gap as determined by existing foil bearing design methods. The components of the foil bearing assembly 300, such as outer foil layer 302, the inner foil layer 306, and the bump foil layer 310, may be constructed of any suitable material that enables the foil bearing assembly 300 to function as described herein. Suitable materials include, for example and without limitation, metal alloys. In some embodiments, for example, each of the outer foil layer 302, the inner foil layer 306, and the bump foil layer 310** is constructed of stainless steel (e.g., 17-4 stainless steel).

Referring again to FIG. 3, the foil bearing assembly 300 in the illustrated embodiment further includes a pair of foil keepers 312*a*/312*b* positioned adjacent opposite ends of the layers 302/306/310 to inhibit sliding of the layers 302/306/310 in an axial direction within the cylindrical bore 206 of the sleeve 202. A pair of foil retaining clips 314*a*/314*b* positioned adjacent to the foil keepers 312*a*/312*b*, respectively, fix the layers 302/306/310 in a locked axial position within the cylindrical bore 206. Foil retaining clips 314*a*/314*b* may be removably connected to bearing housing 200.

Figure 4:
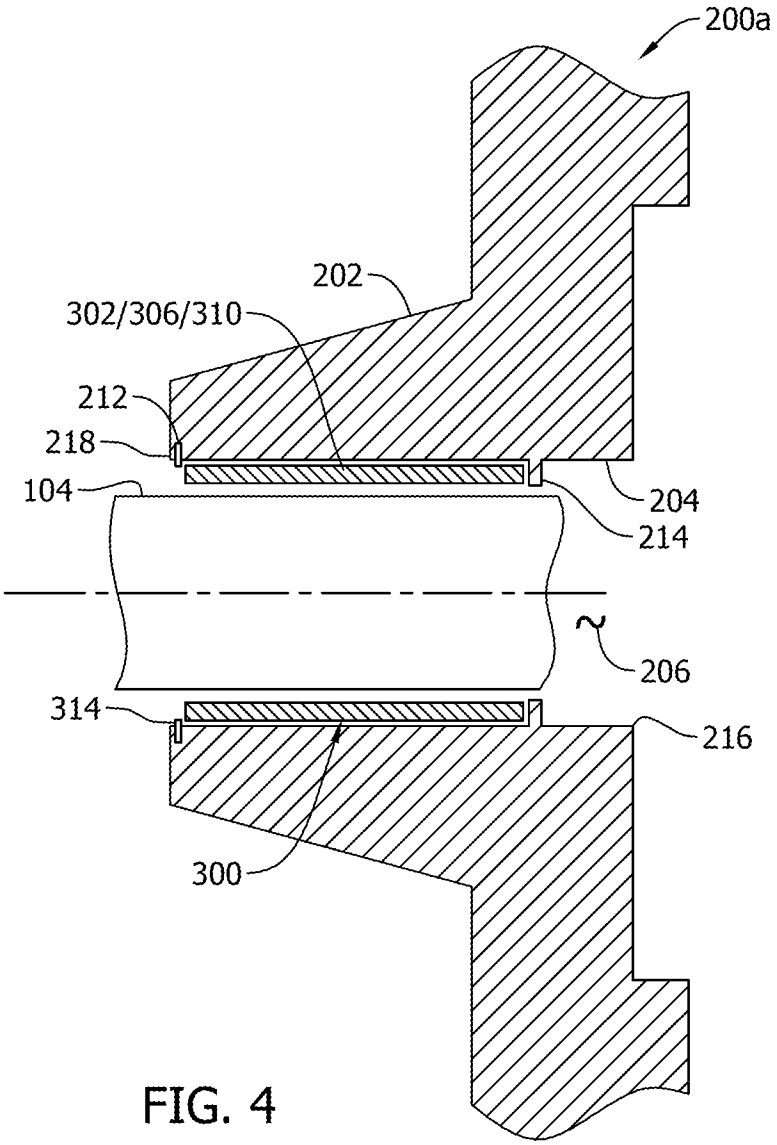
FIG. 4 is a cross-sectional view of another embodiment of a bearing housing suitable for use in the compressor of FIG. 1, illustrating the driveshaft supported within a foil bearing assembly maintained within the bearing housing between a retaining lip formed within the bearing housing at one end and a retaining clip at an opposite end.

In other embodiments, as illustrated in FIG. 4, each bearing housing 200*a* includes a foil retaining lip 214 formed integrally (e.g., cast) with the bearing housing 200*a* and projecting radially inward from the radial inner surface 204 that defines the cylindrical bore 206. In the illustrated embodiment, the foil retaining lip 214 is positioned near a compression mechanism end 216 of the cylindrical bore 206 proximal to the compression mechanism 116 (shown in FIG. 2). The foil retaining lip 214 is sized and dimensioned to project a radial distance from the radial inner surface 204 that overlaps at least a portion of the layers 302/306/310 of the foil bearing assembly 300. The foil retaining lip 214 may extend fully around the circumference of the radial inner surface 204, or the foil retaining lip can include two or more segments extending over a portion of the circumference of the radial inner surface 204 and separated by spaces flush with the adjacent radial inner surface 204. Bearing housing 200 (not shown in FIG. 4) is similarly formed.

The foil bearing assembly 300 of the embodiment illustrated in FIG. 4 further includes a single foil retaining clip 314 positioned adjacent the ends of the layers 302/306/310 opposite the foil retaining lip 214 to inhibit axial movement of the layers 302/306/310 within the cylindrical bore 206 of the sleeve 202. In this embodiment, the foil retaining clip 314 snaps into a circumferential groove 212 formed within the radial inner surface 204 of the cylindrical bore 206 near a motor end 218 of the cylindrical bore 206.

The foil retaining lip 214 may be positioned within any region of the cylindrical bore 206 near the compression mechanism end 216 including, without limitation, a position immediately adjacent to the opening of the cylindrical bore 206 at the compression mechanism end 216. Alternatively, the foil retaining lip 214 may be positioned within any region of the cylindrical bore 206 near the motor end 218 including, without limitation, a position immediately adjacent to the opening of the cylindrical bore 206 at the motor end 218. In such embodiments, the foil retaining clip 314 snaps into a circumferential groove 212 formed within the radial inner surface 204 of the cylindrical bore 206 near the compression mechanism end 216, in an arrangement that is essentially the opposite of the arrangement illustrated in FIG. 4.

Referring again to FIG. 4, the foil bearing assembly 300 is installed within the bearing housing 200 by inserting the foil bearing assembly 300 into the cylindrical bore 206 of the bearing housing 200 at the motor end 218. The foil bearing assembly 300 is then advanced axially into the cylindrical bore 206 toward the compression mechanism end 216 until the layers 302/306/310 contact the foil retaining lip 214. The foil retaining clip 314 is then snapped into the circumferential groove 212 near the motor end 218 of the cylindrical bore 206 to lock the foil bearing assembly 300 in place.

In other embodiments, any suitable method for affixing the foil bearing assembly 300 within the sleeve 202 may be used. Non-limiting examples of suitable methods include keepers and retaining clips, adhesives, set screws, and any other suitable affixing method.

The bearing housings 200/200*a* may further serve as a mounting structure for a variety of elements including, but not limited to, radial bearings, such as the foil bearing assembly 300 described above, a thrust bearing, and sensing devices (not shown) used as feedback for passive or active control schemes such as proximity probes, pressure transducers, thermocouples, key phasers, and the like.

The foil bearing assembly 300 may be provided in any suitable form without limitation. For example, the foil bearing assembly 300 may be provided with two layers, three layers, four layers, or additional layers without limitation. The bump foil 310 of the foil bearing assembly 300 may be formed from a radially elastic structure to provide a resilient surface for the spinning driveshaft 104 during operation of the compressor 100. The bump foil 310 may be formed from any suitable radially elastic structure without limitation including, but not limited to, an array of deformable bumps or other features designed to deform and rebound under intermittent compressive radial loads, and any other elastically resilient material capable of compressing and rebounding under intermittent compressive radial loads. The bump foil 310 may be connected to at least one adjacent layer including, but not limited to, at least one of the outer layer 302 and the inner layer 306. In some embodiments, the bump foil 310 may be connected to both the outer layer 302 and the inner layer 306. In other embodiments, the bump foil 310 may be free-floating and not connected to any layer of the foil bearing assembly 300.

Figure 6:
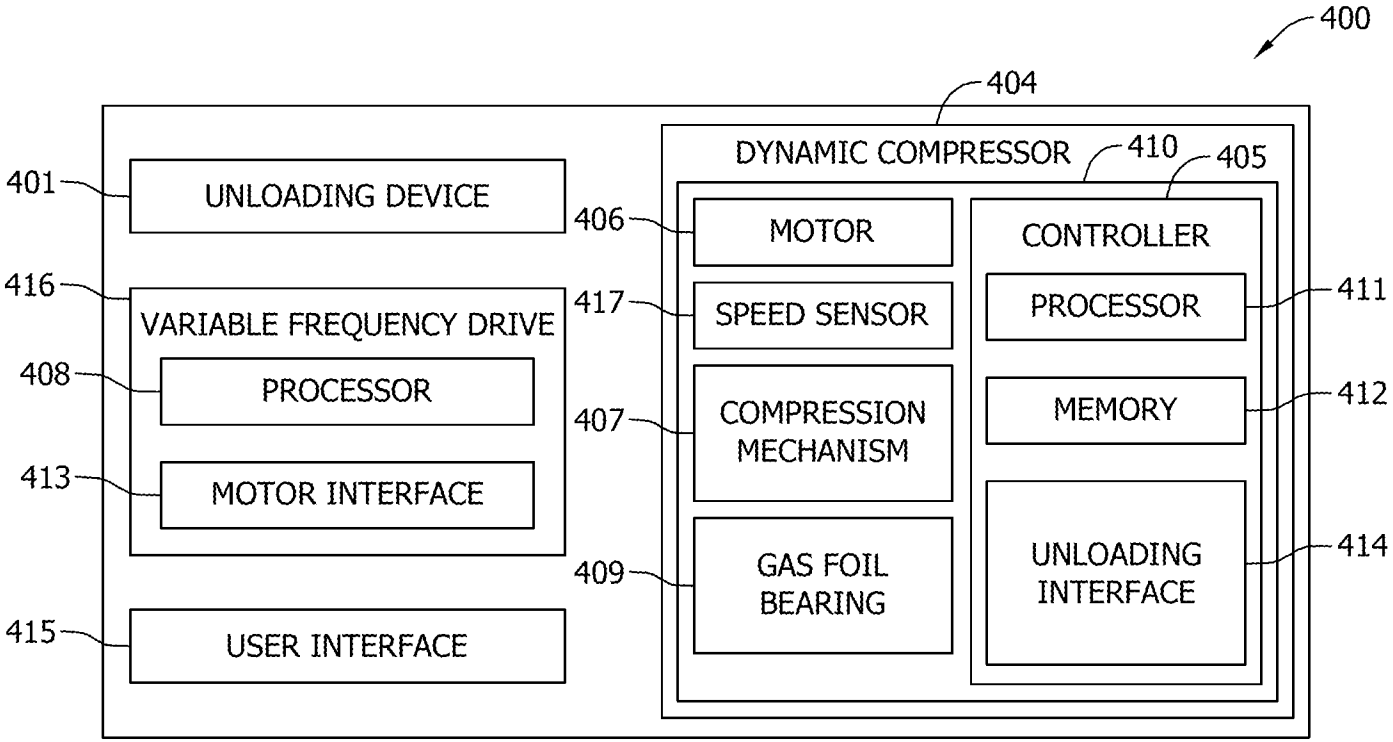
FIG. 6 is a block diagram of a control system for a dynamic compressor.

Referring to FIG. 6, an example embodiment of a system 400 includes a dynamic compressor 404. In an embodiment, the dynamic compressor is a centrifugal compressor. In other embodiments, the dynamic compressor is an axial compressor. The system 400 includes the compressor 404 with a compressor housing 405, an unloading device 401, a user interface 415, and a controller 410. The compressor includes a motor 406, a compression mechanism 407, a gas foil bearing 409, and a speed sensor 417. The system 400 further includes a variable frequency drive (VFD) 416 with a current sensor 408 and a motor interface 413 in communication with the motor 406. In some embodiments, the VFD 416 operates under the control of the controller 410. In some embodiments, the VFD 416 is a part of the controller 410. In the example embodiment, the compression mechanism 407 is an impeller, and the dynamic compressor 404 is a centrifugal compressor. In other embodiments, the compression mechanism 407 is blades, and the dynamic compressor 404 is an axial compressor. The compressor housing 405 and the compressor 404 including the motor 406, the compression mechanism 407, and the gas foil bearing 409 may be constructed similarly to the compressor 100 described in FIG. 1-5 or may be constructed in a different manner. The compressor 404 is not limited to a specific construction in the system 400. The compressor 404 includes a controller 410 for controlling operation of the compressor 404 and determining when a surge event has occurred and whether or not to take a protective action when one or more surge events have occurred. The controller 410 includes a processor 411, a memory 412, and an unloading interface 414. The memory 412 contains instructions that are executed by processor 411 to control the compressor 404 and to perform the methods of determining if and when a surge event has occurred and whether or not to take a protective action in response.

The unloading device 401 in the system 400 removes and/or reduces the load on the compressor during start-up and shut-down routines and detected surge events to limit severity of surge events. In the example embodiment, the unloading device 401 is a bypass valve. Bypass valves, such as refrigerant bypass valves, provide an alternative path for the gas, thereby stopping the pressure rise of the compressor 404 and limiting any potential surging, no matter how slowly the compressor motor 406 is accelerating during start-up or decelerating during shut-down. In other embodiments, the unloading device 401 is an expansion valve. In other embodiments, the unloading device 401 may be a variable orifice or diameter valve, such as a servo valve, and a fixed orifice or diameter valve, such as a solenoid valve or a pulse-width-modulated (PWM) valve configured to control opening and closing according to a duty cycle. In still other embodiments, the unloading device 401 may be, but is not limited to, a variable diffuser, or a Variable Inlet Guide Vane (VIGV). Although many types of unloading devices are described here, the unloading device 401 may be any suitable device, or combination of devices, that reduce the load on the compressor 404.

The unloading device 401 is operatively coupled to the controller 410, and the controller 410 is configured to control at least one operating parameter of the unloading device 401, such as opening a bypass valve. The current sensor 408 measures a current of the motor 406 and the controller 410 determines if and when a surge event of the compressor 404 has occurred by detecting a spike in the measured current of the motor 406. The controller 410 further determines when a surge event is completed and normal operation resumes when the measured current of the motor 406 is substantially constant. Other embodiments may detect occurrence and termination of a surge event using other techniques, such as detecting a change in voltage, detecting a change in pressure, sensing vibrations caused by the surge, or the like. The controller 410 further determines whether or not to take a protective action when a surge event has occurred. Non-limiting examples of suitable sensors for use in the one or more control schemes include temperature sensors, pressure sensors, flow sensors, current sensors, voltage sensors, rotational rate sensors, and any other suitable sensors.

Control system 400 includes a motor interface 413 for connection of the VFD 416 to the motor 406, an interface for connection of the controller 410 to the VFD 416, and an unloading interface 414 for connection of the controller 410 to the unloading device 401. The processor 411 may then execute instructions stored in memory 412 to determine when a surge event has occurred based at least in part on the received signals representing the current from the VFD 416 to the motor 406, and whether or not to take a protective action when the processor 411 determines that a surge event has occurred.

Control system 400 includes a user interface 415 configured to output (e.g., display) and/or receive information (e.g., from a user) associated with the system 400. In some embodiments, the user interface 415 is configured to receive an activation and/or deactivation input from a user to activate and deactivate (i.e., turn on and off) or otherwise enable operation of the system 400. Moreover, in some embodiments, user interface 415 is configured to output information associated with one or more operational characteristics of the system 400, including, for example and without limitation, warning indicators such as severity alerts, occurrence alerts, fault alerts, and motor speed alerts, as well as a status of the gas foil bearing 409, and any other suitable information.

The user interface 415 may include any suitable input devices and output devices that enable the user interface 415 to function as described herein. For example, the user interface 415 may include input devices including, but not limited to, a keyboard, mouse, touchscreen, joystick(s), throttle(s), buttons, switches, and/or other input devices. Moreover, the user interface 415 may include output devices including, for example and without limitation, a display (e.g., a liquid crystal display (LCD) or an organic light emitting diode (OLED) display), speakers, indicator lights, instruments, and/or other output devices. Furthermore, the user interface 415 may be part of a different component, such as a system controller (not shown). Other embodiments do not include a user interface 415.

In some embodiments, the system 400 may be controlled by a remote control interface. For example, the system 400 may include a communication interface (not shown) configured for connection to a wireless control interface that enables remote control and activation of the system 400. The wireless control interface may be embodied on a portable computing device, such as a tablet or smartphone.

The controller 410 is generally configured to control operation of the compressor 404. The controller 410 controls operation through programming and instructions from another device or controller or is integrated with the control system 400 through a system controller. In some embodiments, for example, the controller 410 receives user input from the user interface 415, and controls one or more components of the system 400 in response to such user inputs. For example, the controller 410 may control the motor 406 based on user input received from the user interface 415.

The controller 410 may generally include any suitable computer and/or other processing unit, including any suitable combination of computers, processing units and/or the like that may be communicatively coupled to one another and that may be operated independently or in connection within one another (e.g., controller 410 may form all or part of a controller network). Controller 410 may include one or more modules or devices, one or more of which is enclosed within system 400, or may be located remote from system 400. The controller 410 may be part of compressor 404 or separate and may be part of a system controller in an HVAC system. Controller 410 and/or components of controller 410 may be integrated or incorporated within other components of system 400. In some embodiments, for example, controller 410 may be incorporated within motor 406 or unloading device 401. The controller 410 may include one or more processor(s) 411 and associated memory device(s) 412 configured to perform a variety of computer-implemented functions (e.g., performing the calculations, determinations, and functions disclosed herein). As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 412 of controller 410 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 412 may generally be configured to store suitable computer-readable instructions that, when implemented by the processor(s) 411, configure or cause controller 410 to perform various functions described herein including, but not limited to, controlling the system 400, controlling operation of the motor 406, receiving inputs from user interface 415, providing output to an operator via user interface 415, controlling the unloading device 401 and/or various other suitable computer-implemented functions.

Figure 7:
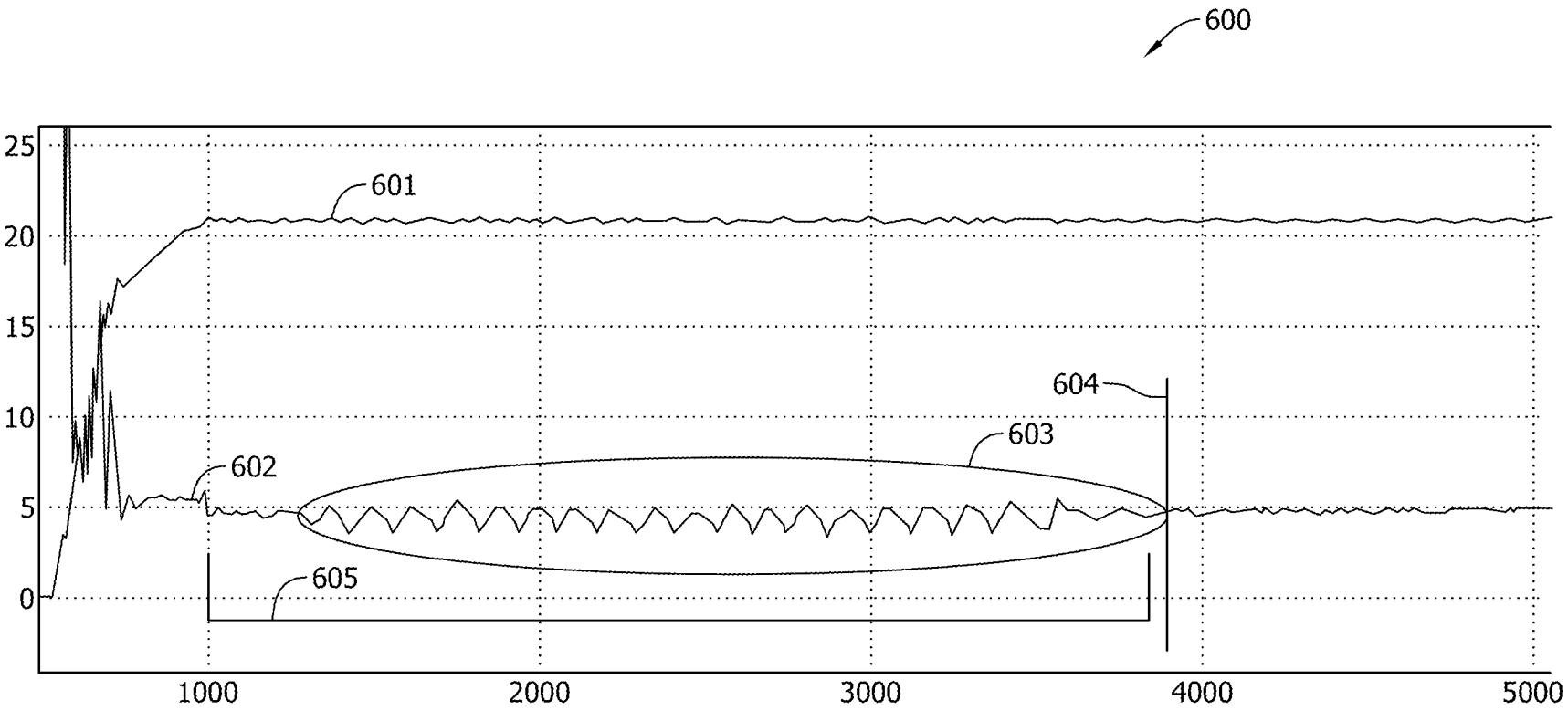
FIG. 7 is a surge current characterization graph for a dynamic centrifugal compressor.

Referring to FIG. 7, a surge current characterization graph 600 during start-up is shown including a speed curve 601 and a motor current curve 602. FIG. 7 shows accelerating the motor speed to a first speed and running the motor 406 at that first speed for a period of time 605. While the motor 406 is running at the first speed for the period of time 605, a region of possible surge 603 has been identified with oscillations in the motor current curve 602. The compressor 404 is held at the first speed until the current oscillating pattern of surge has ceased 604 and the compressor 404 is indicated for full start-up.

Figure 8:
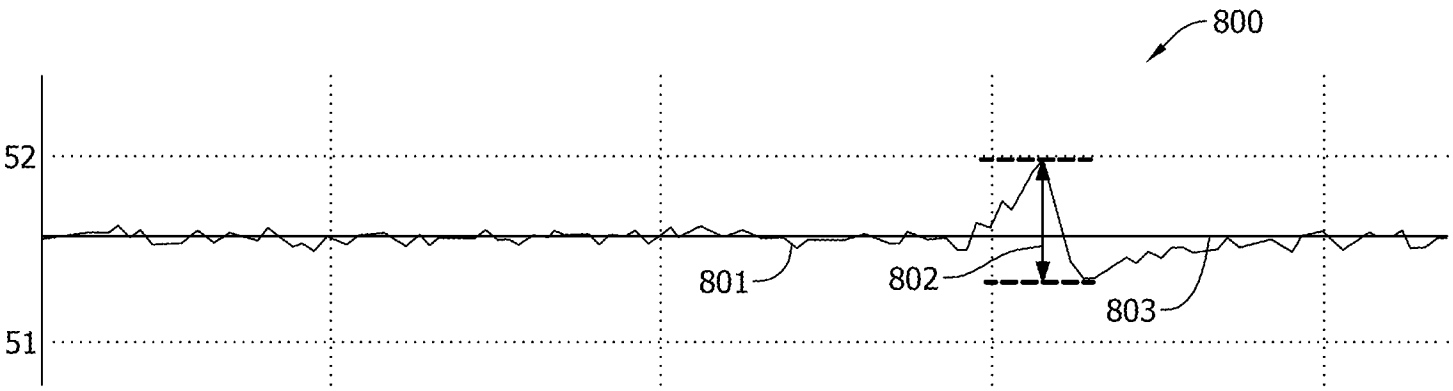
FIG. 8 is a speed graph for a dynamic centrifugal compressor.
Figure 9:
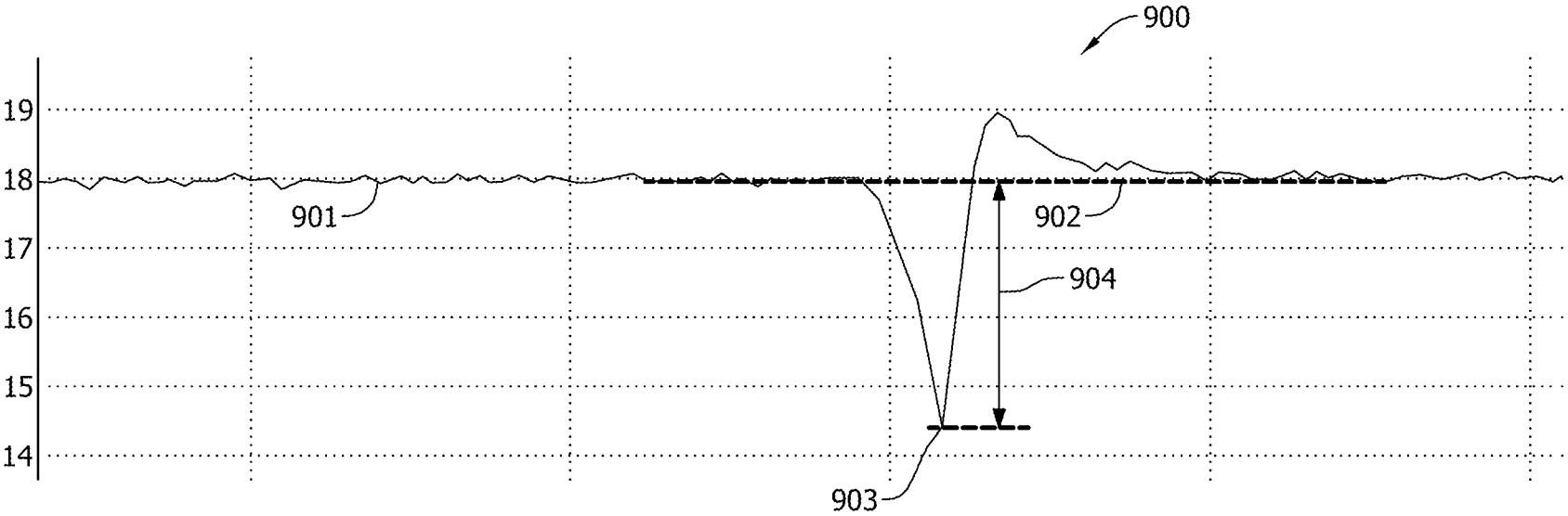
FIG. 9 is a current graph for a dynamic centrifugal compressor.

FIG. 8 and FIG. 9 are traces of signals used by the system to detect the occurrence of a surge (e.g., during the period of time 605 in FIG. 7). FIG. 8 is a speed graph 800 and FIG. 9 is a current graph 900. Regarding FIG. 8, the actual speed 801 of the compressor's motor is shown along with a baseline speed line 803, which may be used as a reference point to determine whether a surge occurs. The baseline speed line 803 is also known as the speed set point or the commanded speed. Regarding FIG. 9, the actual current 901 provided to the motor (as detected using the current sensor 408) and the average current 902 are shown. The average current 902 may be the current detected immediately prior to a surge event, an average of all current measurements prior to a surge event, an average of a predetermined or variable number of current measurements before a surge event, or any other suitable current average. When the compressor 404 enters a surge event, the mass flow through the compressor is drastically reduced, thereby reducing the load on the compressor 404 and causing the speed of the unloaded motor 406 to rise above the baseline speed line 803. The VFD 416, via a control algorithm, then lowers the actual current 901 in response to the increased speed to bring the actual speed 801 back to the baseline speed line 803. As the surge ends, the load on the compressor 404 (and the motor 406) returns, causing the speed 801 to drop rapidly. The VFD 416 increases the current to return the speed of the motor to the baseline speed 803. The result is the characteristic overshoot of the actual current 901 and the undershoot of the actual speed 801, seen at the end of the surge event in FIGS. 8 and 9, before the speed and current are returned to their approximate pre-surge levels. The drop in the actual current 901 from the average current 902 is used by the controller to detect the occurrence of the surge event. When the change in current from the average current 902 exceeds a threshold value, the controller determines that a surge event has occurred. The speed graph 800 shows the speed surge severity 802 and the current graph 900 shows the current surge severity 904 during the surge event. The current surge severity is the difference between the average current 902 and the minimum current 903. The severity of each surge event may be recorded in memory 412.

Figure 10:
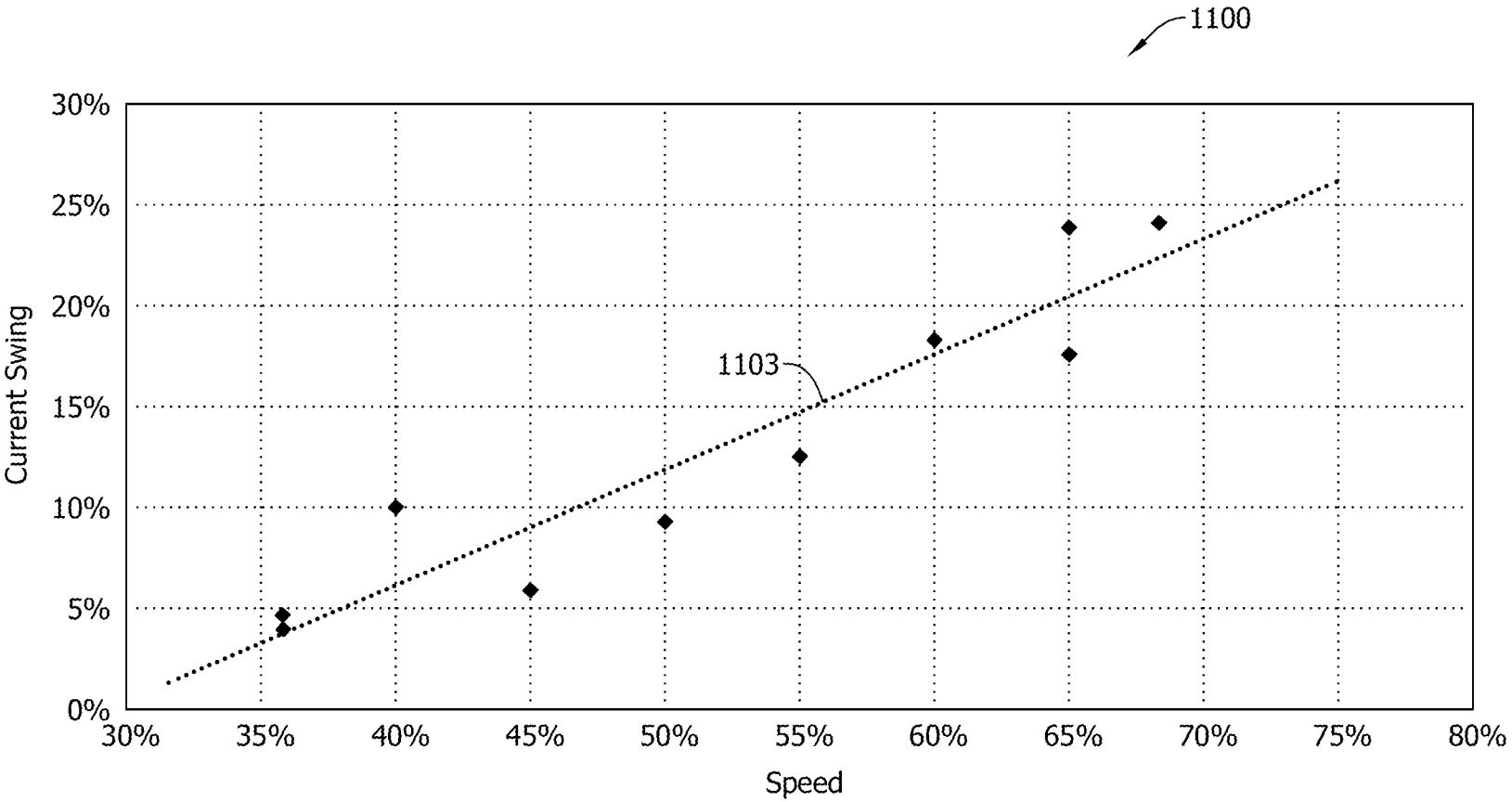
FIG. 10 is a graphical relationship between current swing percentage and speed percentage for a dynamic centrifugal compressor.

Referring to FIG. 10, an example graphical relationship 1100 between the current swing percentage and the speed percentage is shown to illustrate the threshold current swing for detection of a surge event. A linear surge curve 1103 represents the threshold for detection of a surge. A current swing (e.g. surge severity 904 in FIG. 9) on or above the linear surge curve 1103 at the current speed of the compressor (expressed as a percentage of maximum speed) is determined to indicate the occurrence of a surge event. If the current swing is below the linear surge curve 1103, a surge event is not detected. Alternatively, only current swings above the linear surge curve 1103 may be considered surge events, and current swings below the linear surge curve may be considered not surge events.

Figure 11:
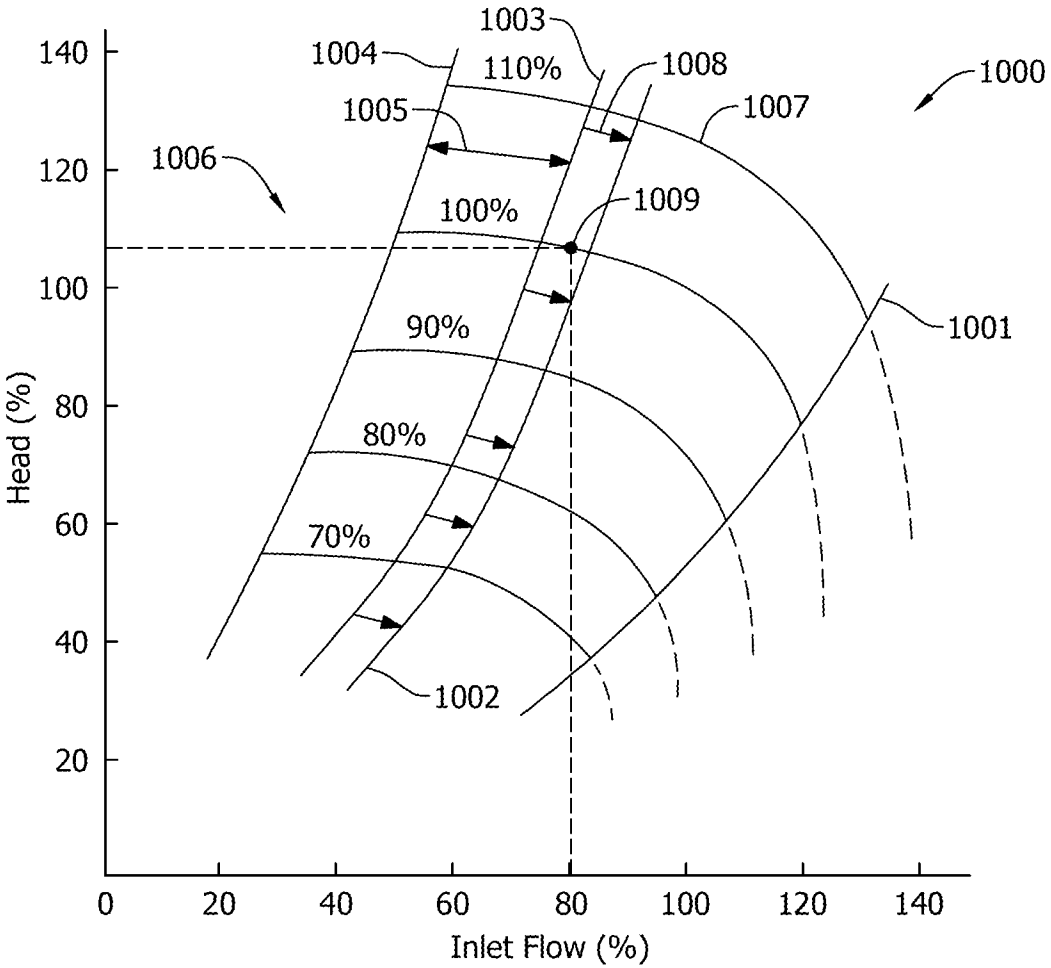
FIG. 11 is an operating map of a dynamic centrifugal compressor.

Referring to FIG. 11, an operating envelope or operating map 1000 of an example dynamic centrifugal compressor 404 is shown. The operating map 1000 graphically estimates and shows a compressor's performance in terms of flows, heads, and speeds. The map shows head vs. inlet mass flow rate as a percentage of their values at the design point of the compressor 404. Inlet mass flow rate is a measure of the amount of a working fluid, such as a refrigerant, flowing through the compression mechanism 407. The head is a total pressure ratio of exit pressure to inlet pressure. The operating map 1000 shows a plurality of compressor speed lines 1007. In this example, there are five speed lines 1007 that range from 110% design speed down to 70% design speed, with each line separated by a 10% difference. Although these particular speed lines are shown in this example, any number of speed lines at any different percentages of the compressor design speed may be shown for any type of compressor.

A surge limit line 1004 indicates the maximum loading condition before surging occurs in the surge region 1006 (i.e., to the left of surge limit line 1004). A surge control line 1003 roughly indicates the maximum loading condition under which the compressor 404 can safely operate without risk of slipping into surge. The surge control line 1003 is defined by a surge margin 1005 from the surge limit line 1004. By operating to the right of the surge control line 1003, the compressor should avoid surging. One operating point 1009 of the operating map 1000 for the compressor 404 is shown as the intersection of a speed line, inlet mass flow rate, and total pressure ratio. For example, the operating point 1009 shown in operating map 1000 is at 80% inlet mass flow rate, 108% head, and 100% speed. If a surge occurred when operating at operating point 1009, the surge margin 1005 may be increased, for example, by an amount 1008 to shift the surge control line 1003 to a new surge control line 1002. The choke line 1001 is shown in the operating map 1000.

Figure 12:
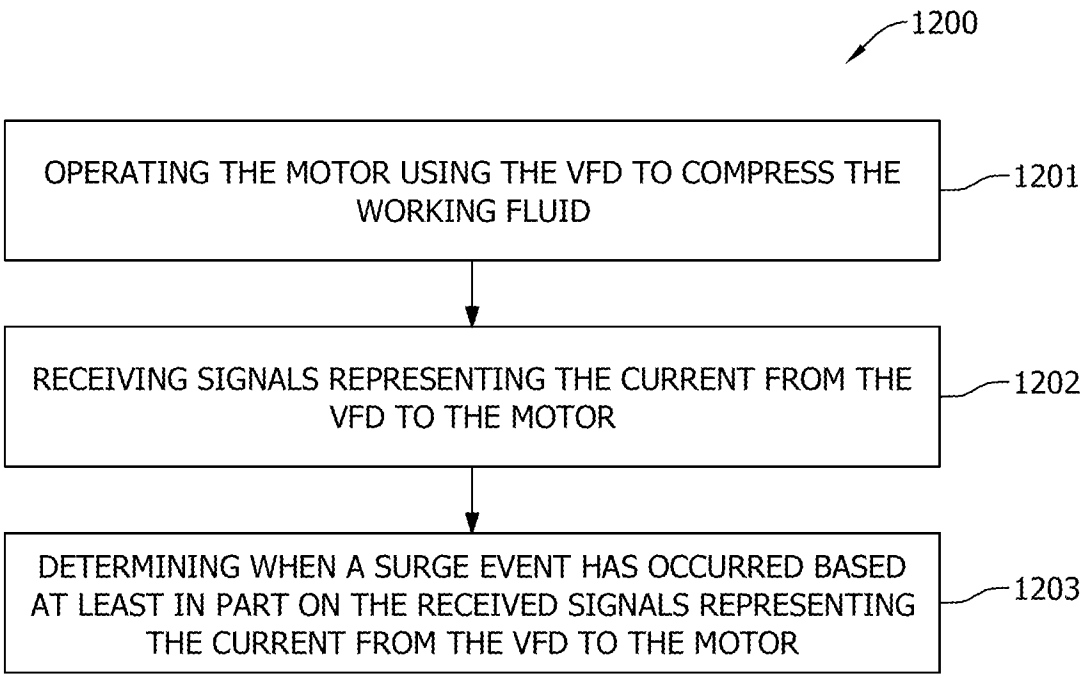
FIG. 12 is a flowchart of a method of determining when surge events have occurred for a dynamic centrifugal compressor.

Referring to FIG. 12, a method 1200 is shown for determining when a surge event has occurred. The method 1200 begins with operating 1201 the motor 406 using the VFD 416 to compress working fluid. In some embodiments, the working fluid is a refrigerant. Once the motor is operating 1201, the method 1200 continues with receiving 1202 signals representing current from the VFD 416 to the motor 406. The method 1200 concludes by determining 1203 when a surge event has occurred based at least in part on the received signals representing the current from the VFD 416 to the motor 406. The method 1200 is implemented on the control system 400, shown in FIG. 6. Specifically, the controller 410 implements the method 1200 via the processor 411 using instructions stored on the memory 412. The measurement of the current to the motor 406 is provided by the current sensor 408 included with the VFD 416. Other embodiments may use any other suitable detection or estimation of the current provided to the motor 406. The compression of the working fluid in operating 1201 the motor 406 is done by the compression mechanism 407.

Determining 1203 that a surge event has occurred includes determining a difference between a previous current and a present current based on the received signals representing the current from the VFD 416 to the motor 406. In some embodiments, the previous current is determined by averaging a plurality of the signals representing the current from the VFD 416 to the motor 406 that are received by the processor 411 before receiving a signal from the VFD representing the present current from the VFD 416 to the motor 406. A surge event has occurred when the difference between the previous current and the present current exceeds a surge threshold. For example, the surge threshold is a variable threshold (e.g., as shown in FIG. 10) and may be pre-loaded onto the controller 410 by a user and subsequently changed via the user interface 415. The variable surge threshold is determined based at least in part on the detected speed from the speed sensor 417 of the motor 406 when the signal representing the present current is received. In other embodiments, determining a difference between a previous current and a present current based on the received signals representing the current from the VFD 416 to the motor 406 includes determining a magnitude of the surge based on the difference between the previous current and the present current. The processor 411 stores an indication of an occurrence of a surge event and the determined magnitude of the surge in memory 412.

Figure 13:
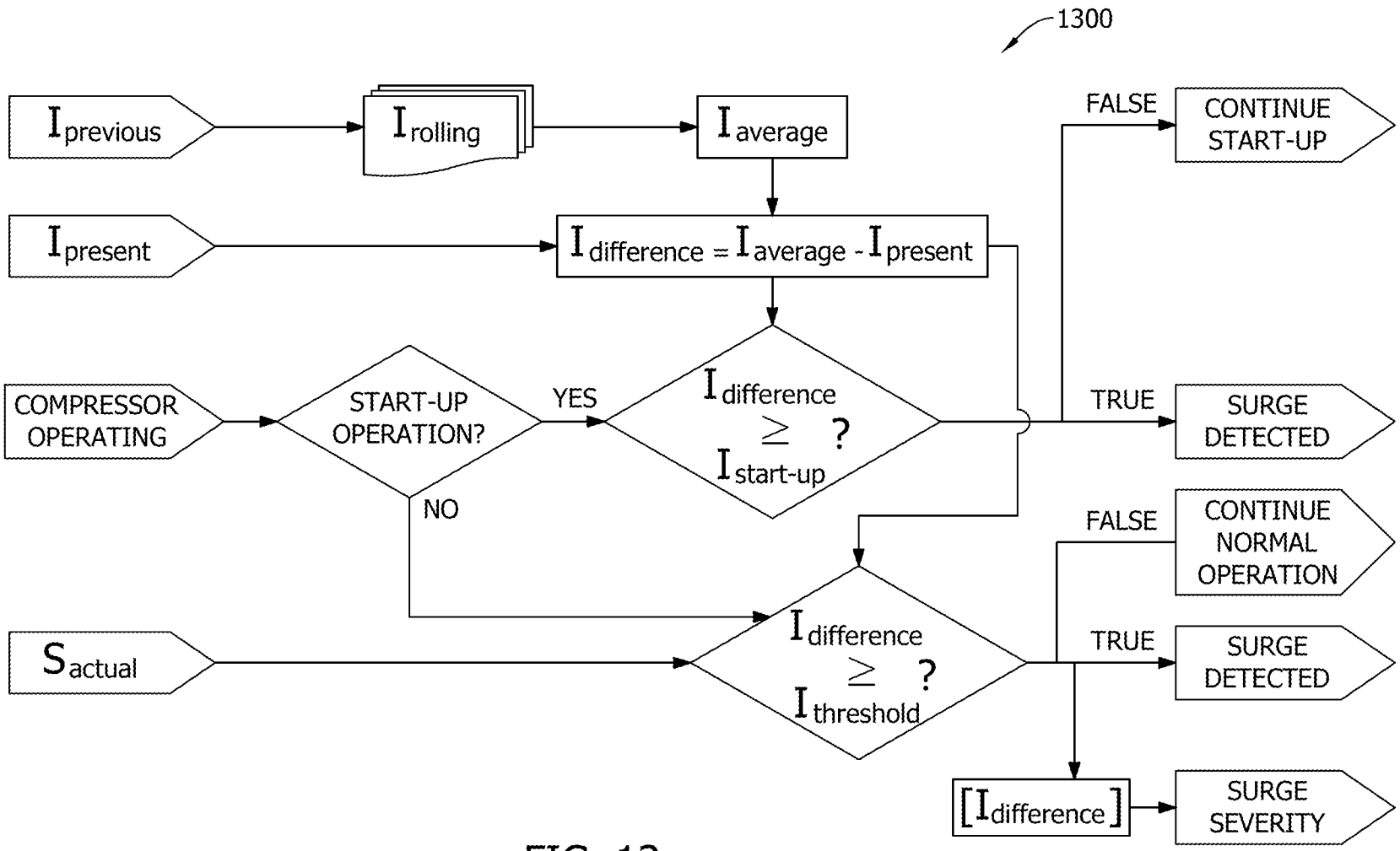
FIG. 13 is a flowchart of an example embodiment of the method of FIG. 12.

Referring to FIG. 13, a flow chart 1300 of an example embodiment of the method 1200 from FIG. 12 for determining a surge event is shown. The flowchart 1300 begins when the compressor 404 is starting up. The flowchart 1300 shows cases of both normal operation and start-up operation of the compressor 404 when determining whether a surge event has occurred. The compressor 404 begins operating, and the current sensor 408 continuously measures the present current $I_{present}$ and the speed sensor 417 continuously measures the speed $S_{actual}$. As the compressor 404 is operating, N number of the previously measured currents $I_{previous}$ are stored in the memory 412 in a rolling data set $I_{rolling}=\{I_{previous1}, I_{previous2}, \ldots I_{previousN}\}$. The rolling data set $I_{rolling}$ may include any N number of currents $I_{previous}$ previously measured before $I_{present}$ over a period of time to create a subset. Once a rolling data set $I_{rolling}$ is created and stored in memory 412, a rolling average $I_{average}\Sigma_{i=1}^{N}(I_{rolling})$ is generated for the period of time associated with the rolling data set $I_{rolling}$. The "rolling average" is an average of a series of measured current values with a fixed subset size. Once the first average $I_{average}$ is taken by the controller 410 of the first subset of current values $I_{rolling}$ for a period of time, the subset is modified by shifting forward or excluding the first current value in the rolling data set and adding a new (e.g., the most recent) current value, so a new subset $I_{rolling2}=\{I_{previous2}, I_{previous3}, \ldots I_{previous+1}\}$ is then generated and stored in memory 412 over a different time interval. This is done continuously over the entire current data set for the life of the compressor 404. The rate at which subsets $I_{rolling}$ are created and stored may be set by an OEM or may be tuned by a user via user interface 415. The controller 410 calculates the difference $I_{difference}$ between the rolling average $I_{average}$ and the present current $I_{present}$. The controller 410 then checks whether the compressor 404 is in start-up operation. If the compressor 404 is in start-up operation, the difference $I_{difference}=I_{average}=I_{present}$ is compared to a pre-set start-up current $I_{start\text{-}up}$. In some embodiments, the start-up current $I_{start\text{-}up}$ is 2 amps. In other embodiments, the start-up current $I_{start\text{-}up}$ is any other suitable fixed or variable current. If the difference $I_{difference}$ is greater than or equal to the start-up current $I_{start\text{-}up}$, then a surge event has been detected. If a surge event has been detected, then the occurrence of the surge event is stored in memory 412. If the compressor is in normal operation, the controller 410 determines a surge threshold current $I_{threshold}$ based on the detected speed $S_{actual}$ of the compressor 404. The surge threshold current $I_{threshold}$ is found by using the graphical relationship 1100 between the current swing percentage and the speed percentage of the compressor 404 described above in FIG. 10. That is, in the example embodiment, the surge threshold current $I_{threshold}$ is the current swing percentage of the linear surge curve 1103 at the speed percentage of the detected speed $S_{actual}$. Other embodiments may define the threshold in terms of absolute speed, absolute current swing, or any suitable combination. Some embodiments may list the surge threshold currents in a lookup table, or any other suitable format. If the difference $I_{difference}$ is greater than or equal to the surge threshold current $I_{threshold}$ then a surge event has occurred and been detected. If a surge event has occurred, then the occurrence of the surge event is stored in memory 412 and magnitude of the associated difference $I_{difference}$ is stored in memory 412 as the surge severity. In both start-up operation and normal operation of the compressor 404, if a surge event is not detected, the compressor 404 continues with the start-up operation or normal operation until a surge event is detected in the future with a new subset of measured currents.

Figure 14:
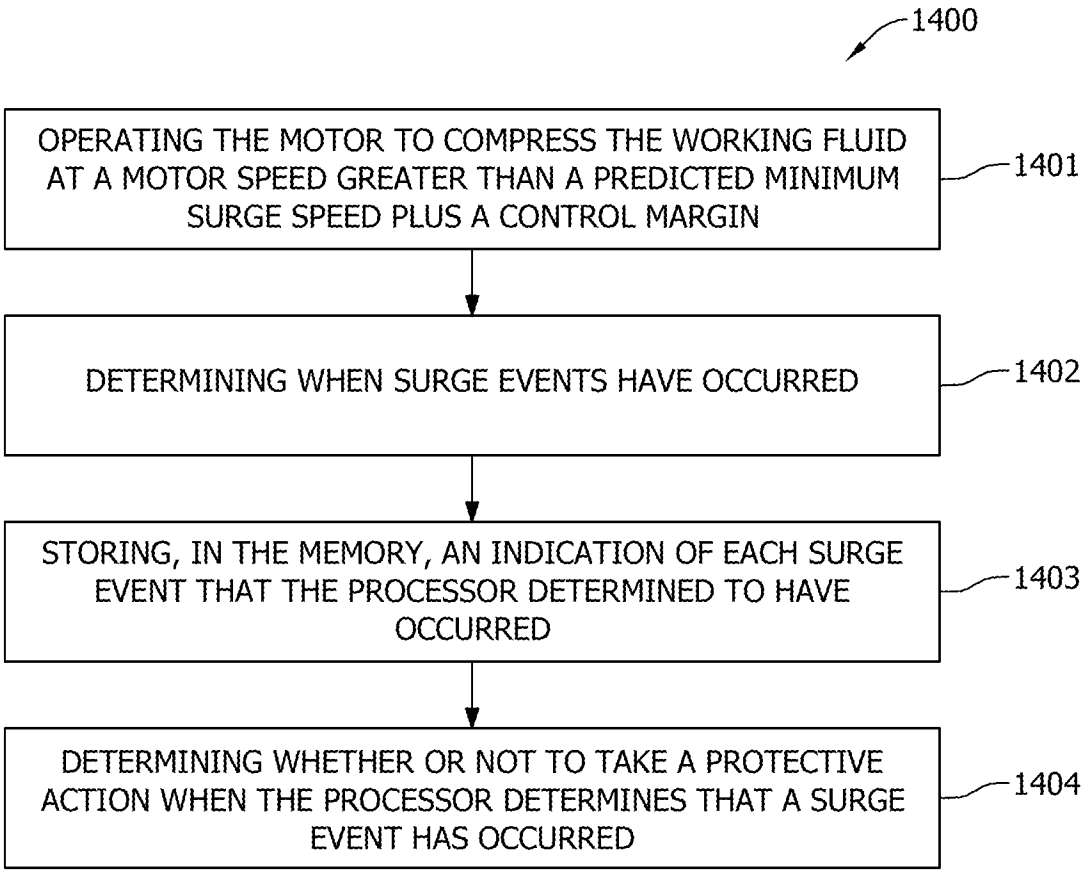
FIG. 14 is a flowchart of a method of determining whether or not to take a protective action when a surge event has occurred for a dynamic centrifugal compressor.

Referring to FIG. 14, a method 1400 for determining whether or not to take a protective action when the processor 411 determines that a surge event has occurred is shown. The method 1400 occurs after the method 1200 shown in FIG. 12 determines that a surge event has occurred. Although the previous method 1200 may be used concurrently to determine the occurrence of surge events, the method 1400 may be utilized in any situation wherein a surge event has been detected (by any detection means) in a dynamic compressor. The method 1400 begins with operating 1401 the motor 406 to compress working fluid at a motor speed greater than a predicted minimum surge speed plus a control margin. The method continues with determining 1402 when surge events have occurred. In some embodiments, this step may utilize the method 1200 to determine the surge event has occurred. The method 1400 continues with storing 1403, in the memory 412, an indication of each surge event that the processor 411 determined to have occurred The method 1400 concludes with determining 1404 whether or not to take a protective action when the processor 411 determines that a surge event has occurred. In some embodiments, the protective action includes generating an alert. The alert may be a warning signal transmitted to a remotely located system controller, a visual or audible alert located near the compressor, or any other suitable alert. In some embodiments, the protective action includes stopping the motor 406. In some embodiments, the protective action includes adjusting the control margin. Similar to the previous method 1200, the method 1400 is implemented on the control system 400, shown in FIG. 6. Specifically, the controller 410 implements the method 1400 via the processor 411 using instructions stored on the memory 412. The compression of the working fluid in operating 1401 the motor 406 is done by the compression mechanism 407.

If the determining 1404 step of method 1400 concludes that generating an alert is the protective action needed after the processor 411 determines a surge event has occurred, then the following steps are further taken in various embodiments. Generating an alert may include generating an occurrence alert when a number of surge events having an indication stored in the memory 412 is greater than or equal to an occurrence alarm limit. Generating an alert may include generating a fault alert when the number of surge events having an indication stored in the memory 412 is greater than or equal to a fault limit that is greater than the occurrence alarm limit. When the fault alert is generated, then a control margin, such as the control margin 1005 of the operating map 1000 shown in FIG. 11, is increased for the dynamic compressor 404 in some embodiments. In some embodiments, the indication of each surge event includes an indication of a magnitude of the surge event, and generating an alert includes generating a severity alert when a sum of the magnitudes of the determined surge events stored in the memory 412 is greater than or equal to a severity alarm limit. Generating the alert further includes generating a fault alert when the sum of the magnitudes of the determined surge events stored in the memory 412 is greater than or equal to a severity fault limit that is greater than the severity alarm limit in some embodiments. Then, as described above, when the fault alert is generated, the control margin may be increased. In some embodiments, generating an alert occurs if a speed of the motor 406 during the surge event exceeds a sum of the predicted minimum surge speed, the control margin, and a charge margin, when the working fluid is a refrigerant. Then, as described above, when the alert is generated, the control margin is increased.

If the determining 1404 step of method 1400 concludes that stopping the motor 406 is the protective action needed after determining a surge event has occurred, with the indication of each surge event including a magnitude of the surge event, then the method may include the following. In some embodiments, stopping the motor 406 occurs when a number of detected surge events is greater than or equal to an occurrence shutdown threshold. Alternatively or additionally, the motor 406 may be stopped when a sum of the magnitudes of the determined surge events is greater than or equal to an accumulation shutdown threshold.

Figure 15:
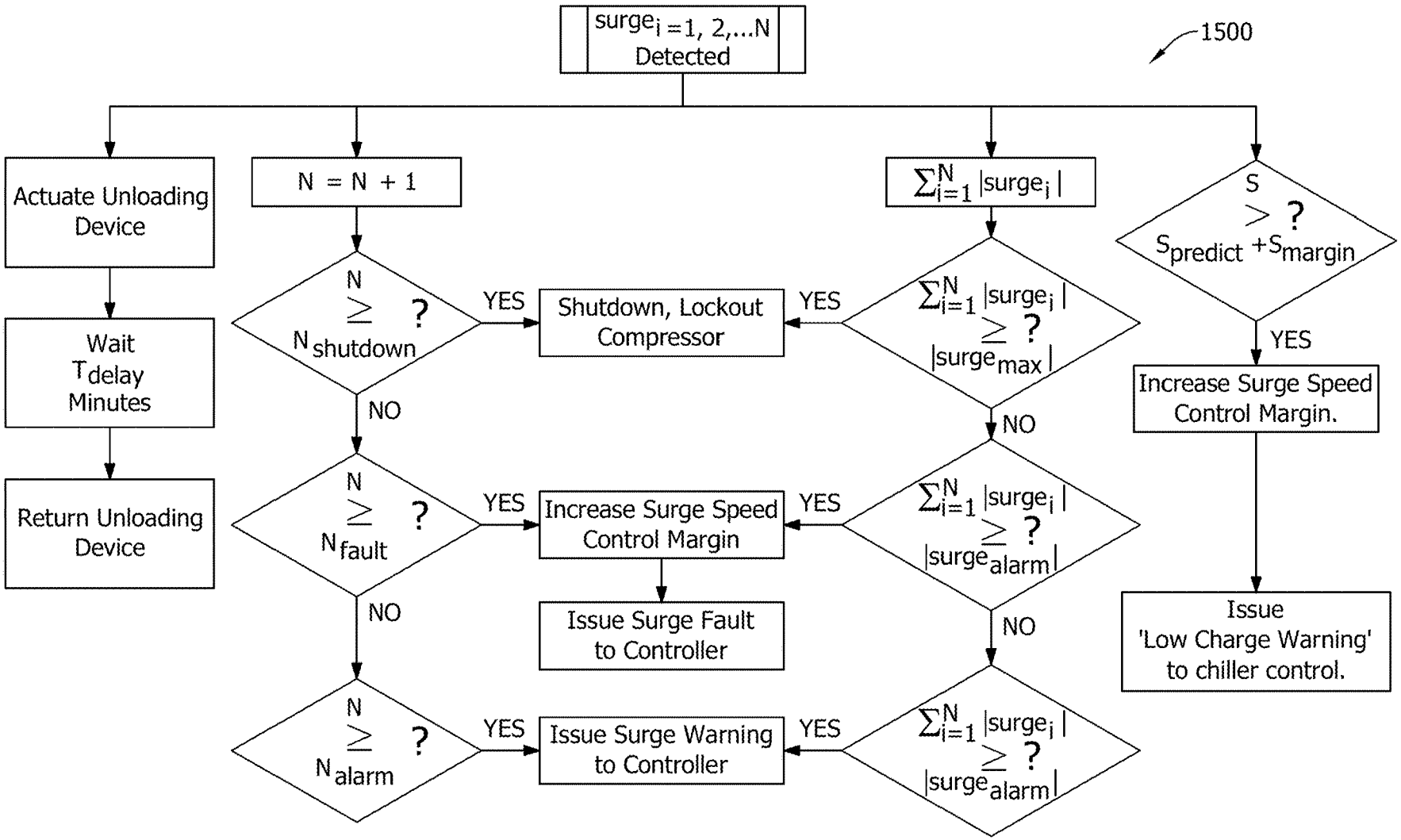
FIG. 15 is a flowchart of an example embodiment of the method of FIG. 14.

Referring to FIG. 15, a flowchart 1500 of an example embodiment of the method 1400 from FIG. 14 for determining whether or not to take a protective action when a surge event has occurred in dynamic compressor 404 is shown. The flowchart 1500 begins when a surge event $surge_{i=1,2,\ldots N}$ is detected. Once detected, a surge count Nis incremented N=N+1. Simultaneously, as the surge count N is incremented N=N+1, a surge severity accumulation is calculated. The surge severity accumulation is the sum of the magnitudes of all of the N detected surge events $\Sigma_{i=1}N|surge_i|$. Next, the surge count N and the surge severity accumulation $\Sigma_{i=1}^{N}|surge_i|$ are checked to see if a shut-down condition for the compressor 404 is met. If the surge count N is greater than or equal to a shut-down surge count limit $N_{shutdown}$ ($N \geq N_{shutdown}$), or if the surge severity accumulation $\Sigma_{i=1}^{N}|surge_i|$ is greater than or equal to a shut-down surge severity limit $|surge_{max}|$($\Sigma_{i=1}^{N}|surge_i| \geq |surge_{max}|$), then the control system 400 initiates shut-down and the compressor 404 is locked out. If the conditions for shut-down as described above are not met, then a fault check is conducted using thresholds lower than those used in the shut-down determination. If the surge count N is greater than or equal to a fault surge count limit $N_{fault}$($N \geq N_{fault}$), or if the surge severity accumulation $\Sigma_{i=1}^{N}|surge_i|$ is greater than or equal to a fault surge severity limit $|surge_{fault}|$ ($\Sigma_{i=1}^{N}|surge_i| \geq |surge_{fault}|$), then the control system 400 increases the surge speed control margin of the dynamic compressor 404, as indicated by the control margin shift 1008 of the operating map 1000 shown in FIG. 11. The surge speed control margin may be increased by a fixed amount, by a fixed percentage, or by a variable amount. After the surge speed control margin is increased, a surge fault is issued to the controller 410. In some embodiments, the surge fault is an alarm issued to a separate system controller (not shown in FIG. 6) of an HVAC system of which the dynamic compressor 404 is a part. If the fault conditions as described above are not met, then an alarm limit check is conducted using thresholds lower than those used in the fault check. If the surge count N is greater than or equal to an alarm count limit $N_{alarm}$ ($N \geq N_{alarm}$), or if the surge severity accumulation $\Sigma_{i=1}^{N}|surge_i|$ is greater than or equal to an alarm surge severity limit $|surge_{alarm}|$($\Sigma_{i=1}^{N}|surge_i| \geq |surge_{alarm}|$), then the control system 400 issues a surge warning to the controller 410. In some embodiments, the surge warning is an alarm issued to a separate system controller of an HVAC system. Further, when a surge event is detected, the speed S of the dynamic compressor 404 is measured and compared to a predicted surge speed $S_{predict}$ plus a charge margin $S_{margin}$. If the speed S is greater than the predicted surge speed $S_{predict}$ plus the charge margin $S_{margin}$ ($S > S_{predict} + S_{margin}$), then the surge speed control margin is increased. When this occurs, a low charge warning to the controller 410 is issued indicating that the system may need additional working fluid (e.g., refrigerant). In some embodiments, the low charge warning is an alarm issued to a separate system controller (not shown in FIG. 6) of an HVAC system of which the dynamic compressor 404 is a part. Other embodiments may perform the above comparisons in reverse order. That is, the alarm limit check may be conducted first, the fault check second, and the shutdown check last. In such embodiments, if the alarm limit check determines not to issue a surge warning, the comparisons may be stopped, because the thresholds for the fault check and the shutdown check are larger than the threshold for the alarm limit check, and they cannot be exceeded if the lower alarm limit threshold ($N_{alarm}$) is not exceeded.

In some embodiments, when a surge event is detected, the unloading device is actuated as the protective action to unload the compressor to reduce the severity of the surge. In the example embodiment, the unloading device is a load balance valve and reduces the load on the compressor 404 for time $T_{delay}$ minutes before returning the load on the compressor 404.

Technical benefits of the methods and systems described herein are as follows: (a) continuous monitoring of the number of surge events and surge severity as seen by a compressor in a HVAC system, (b) comparing the surge events and surge severity to the maximum number of surges a compressor can handle in an HVAC system, and (c) comparing compressor speed during surge events to predicted surge speed at a current pressure ratio.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A system comprising:

a dynamic compressor comprising:

a motor having a driveshaft rotatably supported within the dynamic compressor; and a compression mechanism connected to the driveshaft and operable to compress a working fluid upon rotation of the driveshaft; and a controller connected to the motor, the controller comprising a processor and a memory, wherein the memory stores instructions that program the processor to:

operate the motor to compress the working fluid at a motor speed greater than a predicted minimum surge speed plus a control margin;

determine when surge events have occurred;

store, in the memory, an indication of each surge event that the processor determined to have occurred, the indication of each surge event including an indication of a magnitude of the surge event;

sum the magnitudes of the determined surge events stored in the memory;

determine whether or not to take a protective action when the processor determines that a surge event has occurred, wherein the protective action comprises generating an alert, the alert comprises a signal transmitted to a remotely located device, a visual alert, or an audible alert, and determining whether or not to take a protective action comprises:

generating a severity alert as the alert when the sum of the magnitudes of the determined surge events stored in the memory is greater than or equal to a severity alarm limit;

generating a fault alert as the alert when a sum of the magnitudes of the determined surge events stored in the memory is greater than or equal to a severity fault limit that is greater than the severity alarm limit; and increasing the control margin each time the processor determines to generate the fault alert.

2. The system of claim 1, wherein the memory stores further instructions that program the processor to determine to generate an occurrence alert as the alert when a number of surge events having an indication stored in the memory is greater than or equal to an occurrence alarm limit.

3. The system of claim 2, wherein the memory stores further instructions that program the processor to determine to generate a fault alert as the alert when a number of surge events having an indication stored in the memory is greater than or equal to a fault limit that is greater than the occurrence alarm limit.

4. The system of claim 3, wherein the memory stores further instructions that program the processor to increase the control margin each time the processor determines to generate the fault alert.

5. The system of claim 1, wherein the system is an HVAC system, the working fluid is a refrigerant, and the memory stores further instructions that program the processor to:

compare a speed of the motor when each surge event was determined to occur to a sum of the predicted minimum surge speed, the control margin, and a charge margin;

determine to generate the alert when the speed of the motor when the surge event was determined to occur exceeds the sum of the predicted minimum surge speed, the control margin, and the charge margin; and increase the control margin when the processor determines to generate the alert.

6. The system of claim 1, wherein the signal transmitted to the remotely located device comprises a warning signal transmitted to a remotely located system controller.

7. The system of claim 1, wherein the protective action comprises selectively stopping the motor and the memory stores further instructions that program the processor to:

determine to stop the motor when a number of surge events that the processor determined to have occurred is greater than or equal to an occurrence shutdown threshold; and determine to stop the motor when the sum of the magnitudes of the determined surge events stored in the memory is greater than or equal to an accumulation shutdown threshold.

8. The system of claim 1, wherein the system further comprises an unloading device, and the protective action comprises selectively actuating the unloading device to unload the compressor to reduce a severity of the determined surge event.

9. A controller for a dynamic compressor including a motor and a compression mechanism connected to the motor and operable to compress a working fluid upon operation of the motor, the controller comprising:

a processor; and a memory, wherein the memory stores instructions that program the processor to:

operate the motor to compress the working fluid at a motor speed greater than a predicted minimum surge speed plus a control margin;

determine when surge events have occurred;

store, in the memory, an indication of each surge event that the processor determined to have occurred, wherein the indication of each surge event includes an indication of a magnitude of the surge event; and determine whether or not to take a protective action when the processor determines that a surge event has occurred, wherein the protective action comprises one of generating an alert, stopping the motor, or unloading the compressor and the processor determines whether or not to take a protective action by:

summing the magnitudes of the determined surge events stored in the memory;

generating a severity alert when the sum of the magnitudes of the determined surge events stored in the memory is greater than or equal to a severity alarm limit;

generating a fault alert when the sum of the magnitudes of the determined surge events stored in the memory is greater than or equal to a severity fault limit that is greater than the severity alarm limit;

increasing the control margin each time the processor determines to generate the fault alert; and stopping the motor when the sum of the magnitudes of the determined surge events stored in the memory is greater than or equal to an accumulation shutdown threshold.

10. The controller of claim 9, wherein the memory stores instructions that program the processor to determine whether or not to take a protective action when the processor determines that a surge event has occurred by:

generating an occurrence alert when a number of surge events having an indication stored in the memory is greater than or equal to an occurrence alarm limit;

generating a fault alert when a number of surge events having an indication stored in the memory is greater than or equal to a fault limit that is greater than the occurrence alarm limit;

increasing the control margin each time the processor determines to generate the fault alert; and stopping the motor when a number of surge events that the processor determined to have occurred is greater than or equal to an occurrence shutdown threshold.

11. The controller of claim 9, wherein the dynamic compressor is part of an HVAC system, the working fluid is a refrigerant, and the memory stores further instructions that program the processor to:

compare a speed of the motor when each surge event was determined to occur to a sum of the predicted minimum surge speed, the control margin, and a charge margin;

determine whether or not to take a protective action when the processor determines that a surge event has occurred by determining to generate a charge alert when the speed of the motor when the surge event was determined to occur exceeds the sum of the predicted minimum surge speed, the control margin, and the charge margin.

12. A method for controlling a dynamic compressor including a motor and a compression mechanism connected to the motor and operable to compress a working fluid upon operation of the motor, the method comprising:

operating the motor to compress the working fluid at a motor speed greater than a predicted minimum surge speed plus a control margin;

determining, by a processor, when surge events have occurred;

storing an indication of each surge event that the processor determined to have occurred; and determining whether or not to take a protective action when the processor determines that a surge event has occurred, wherein the protective action comprises one of generating an alert, stopping the motor, or unloading the compressor and determining whether or not to take a protective action comprises:

summing the magnitudes of the determined surge events stored in the memory;

generating a severity alert when the sum of the magnitudes of the determined surge events stored in the memory is greater than or equal to a severity alarm limit;

generating a fault alert when the sum of the magnitudes of the determined surge events stored in the memory is greater than or equal to a severity fault limit that is greater than the severity alarm limit;

increasing the control margin each time the processor determines to generate the fault alert; and stopping the motor when the sum of the magnitudes of the determined surge events stored in the memory is greater than or equal to an accumulation shutdown threshold.

13. The method of claim 12, wherein determining whether or not to take a protective action when the processor determines that a surge event has occurred comprises:

generating an occurrence alert when a number of surge events having an indication stored in the memory is greater than or equal to an occurrence alarm limit;

generating a fault alert when a number of surge events having an indication stored in the memory is greater than or equal to a fault limit that is greater than the occurrence alarm limit;

increasing the control margin each time the processor determines to generate the fault alert; and stopping the motor when a number of surge events that the processor determined to have occurred is greater than or equal to an occurrence shutdown threshold.

14. The method of claim 12, wherein the dynamic compressor is part of an HVAC system, the working fluid is a refrigerant, and determining whether or not to take a protective action when the processor determines that a surge event has occurred comprises:

comparing a speed of the motor when each surge event was determined to occur to a sum of the predicted minimum surge speed, the control margin, and a charge margin; and determining to generate a charge alert when the speed of the motor when the surge event was determined to occur exceeds the sum of the predicted minimum surge speed, the control margin, and the charge margin.

* * * * *